US007112732B2

(12) United States Patent
Tamura

(10) Patent No.: US 7,112,732 B2
(45) Date of Patent: Sep. 26, 2006

(54) ELECTRIC STRINGED MUSICAL INSTRUMENT HAVING DETACHABLE FRAME

(75) Inventor: Shinya Tamura, Shizuoka (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 10/305,871

(22) Filed: Nov. 27, 2002

(65) Prior Publication Data

US 2003/0145711 A1 Aug. 7, 2003

Related U.S. Application Data

(62) Division of application No. 09/832,457, filed on Apr. 11, 2001, now Pat. No. 6,664,461.

(30) Foreign Application Priority Data

Apr. 12, 2000 (JP) ..... 2000-110759

(51) Int. Cl.
*G10D 3/00* (2006.01)

(52) U.S. Cl. ..... 84/290; 84/743

(58) Field of Classification Search ..... 84/290, 84/291, 743; D17/14, 17
See application file for complete search history.

(56) References Cited

U.S. PATENT DOCUMENTS

| | | | | | |
|---|---|---|---|---|---|
| 3,910,151 | A | | 10/1975 | Copeland | |
| D249,387 | S | * | 9/1978 | Hart | D17/17 |
| 4,235,143 | A | | 11/1980 | Hoexter | |
| 4,242,938 | A | * | 1/1981 | van Zalinge | 84/731 |
| D272,747 | S | | 2/1984 | Nussbaum | |
| 4,433,603 | A | | 2/1984 | Siminoff | |
| D277,291 | S | | 1/1985 | Deal | |
| 4,573,391 | A | | 3/1986 | White | |
| 4,632,002 | A | * | 12/1986 | Clevinger | 84/731 |
| 4,646,613 | A | * | 3/1987 | Banchetti | 84/327 |
| 4,686,882 | A | | 8/1987 | Shaw | |
| 4,770,079 | A | | 9/1988 | Mastroianni | |
| D299,453 | S | | 1/1989 | Brunet | |
| D301,251 | S | | 5/1989 | Nussbaum | |
| 4,873,908 | A | | 10/1989 | Moore | |
| 5,058,479 | A | | 10/1991 | Shaw | |
| 5,251,526 | A | | 10/1993 | Hill | |
| 5,383,385 | A | | 1/1995 | Gilbert | |
| D360,219 | S | | 7/1995 | McCann | |
| D363,946 | S | | 11/1995 | Eberlen | |
| 5,654,514 | A | | 8/1997 | Tracey | |
| D384,689 | S | | 10/1997 | Najarian | |

(Continued)

FOREIGN PATENT DOCUMENTS

DE 698326 10/1963

(Continued)

OTHER PUBLICATIONS

Catalog—B&O Band and Orchestra Production—Nov. 1999—vol. 2, No. 9.

(Continued)

*Primary Examiner*—Jeffrey W Donels
(74) *Attorney, Agent, or Firm*—Dickstein Shapiro LLP

(57) ABSTRACT

An electric double-bass is broken down into a trunk, a detachable framework assembled with the trunk, coupling units provided between the trunk and the detachable framework, accessory parts, strings stretched over the trunk and an electric sound generating system for generating electric tones like acoustic tones of a double-bass, and any resonator is formed in the electric double-bass, wherein a string player disassembles the detachable framework from the trunk for storing the electric double-bass in a case, thereby enhancing the portability of the electric double-bass.

5 Claims, 7 Drawing Sheets

U.S. PATENT DOCUMENTS

| | | | | | |
|---|---|---|---|---|---|
| D395,912 | S | | 7/1998 | Schaub | |
| 5,905,222 | A | | 5/1999 | Yamada | |
| 5,945,614 | A | | 8/1999 | White | |
| 5,945,622 | A | | 8/1999 | Yamada | |
| 5,990,397 | A | | 11/1999 | Taylor | |
| 5,994,633 | A | | 11/1999 | Norton | |
| 6,008,440 | A | * | 12/1999 | Yamada | 84/291 |
| D419,587 | S | * | 1/2000 | Okamura | D17/14 |
| D441,004 | S | * | 4/2001 | Kondo | D17/14 |
| 6,255,565 | B1 | * | 7/2001 | Tamura | 84/275 |

FOREIGN PATENT DOCUMENTS

| | | |
|---|---|---|
| DE | M1904972 | 1/1972 |
| DE | M9301954 | 8/1983 |
| DE | 43 36 002 A1 | 4/1995 |
| DE | M9508840 | 5/1996 |
| DE | 19540668 | 5/1997 |
| DE | M9709817 | 4/1998 |
| DE | M9803763 | 12/1998 |
| DE | 49810393 | 4/1999 |
| DE | 49906534 | 12/1999 |
| FR | 573276 | 3/2000 |
| GB | 2020953 | 9/1992 |
| GB | 2057250 | 1/1997 |
| GB | 2061315 | 1/1997 |
| JP | 56-147494 | 4/1955 |
| JP | 59-1238983 | 8/1984 |
| JP | 60-54187 | 4/1985 |
| JP | 62-140592 | 9/1987 |
| JP | 6-59896 | 8/1994 |
| JP | 11-305762 | 11/1999 |

OTHER PUBLICATIONS

Catalog—MMR Musical Marchandise Review—Apr. 2000.
German Design Trademark—Registration No. 30101918—Registered Feb. 12, 2001.
German Design Trademark—Registration No. 761999—Registered Jul. 11, 2001.
U.S. Trademark—Registration No. 2,401,468—Registered Nov. 7, 2000.
Japanese Design Trademark—Registration No. 1115064—Registered May 18, 2001.
www.abasses.com/upright.html—A Basses Sing Hand-Carved Uprights.
www.warwickbass.com/Basses/triumph.html—Warwick Triumph Electric Upright—Copyright 1997.
www.hutaflorian.com.pl/kania/da-gamba.html—Da Gamba Portable Upright Bass—Publication date unknown.
www.1212.com/c/gougi/inst.html—The Atelier de Lutherie Fabrice Gougi Electrodynamic Instruments.
www.vektor-bass.de/vektor-e.html—The Vector Upright Bass and Vektor Electric Bassett—Publication date unknown.
www.sonic.net/mssngr/index.html—Knutson Luthiary Messenger Upright Electric Bass—Publication date unknown.
www.hembrook.com/html—Hembrook Upright Electric Basses—Publication date unknown.
www.zetamusic.com/products/display.asp?id=51—Zeta Fusion Body—Publication date unknown.
www.personal.u-net.com/starfish/orca.html—Orca 5 String Bass—Publication date unknown.
Magazine Article—"Airbus"—Publication date unknown.
Magazine Article—"Born to Rock" Model F4c Electric Guitar—Publication date unknown.
Magazine Article—"Upright Bass Today"—Publication date unknown.
Magazine Article—Jazz Life—Published Apr. 1994.
Magazine Article—AP SWB-ALPHA—Published May 1997.
Catalog—Travelcelo—Studiocello—Publication date unknown.
Catalog—Zeta—"The UpRite"—Publication date unknown.
Catalog—Traveler Guitar—www.travelerguitar.com—Publication date unknown.
Catalog—HC03040152—Publication date unknown.
Catalog—Basd—Publication unknown.
Catalog—Oriente—Publication ate unknown.
Catalog—SWB (Soild Wood Bass) SWB—Alpa—Publication date unknown.
Catalog—Clevinger—1999.
Catalog—Clevinger Bennet—Our semi-acoustic portable—Publication date unknown.
Catalog—Electric Upright Basses—Publication date unknown.
Catalog—Travelcelo the quiet compact cello for holiday and apartment -.
Catalog—Frame Works—the Frame Guitar—Publication date unknown.
Catalog—Frame Works—The Best of Both Worlds—Publication date unknown.
Catalog—SoloEtte Steel String—Travel Practice Guitar—Publication date unknown.
Catalog—SoloEtte Steel String—Travel/Practice Guitar—Publication date unknown.
Catalog—Aria Sinsonialo AS-490S Steel string guitar including headphone and padded bag—Registration 4201468.
Gisela Unterer, Travelcelo: Bedienungsanleitung, Travelcelo Instruments, Orchester, Schott, Mainz, Germany.
Copy of European Search Report dated Apr. 29, 2004.

* cited by examiner

ELECTRIC STRINGED MUSICAL INSTRUMENT HAVING DETACHABLE FRAME

CROSS-REFERENCE TO RELATED APPLICATIONS

This application is a divisional of U.S. application Ser. No.: 09/832,457, filed on Apr. 11, 2001, now U.S. Pat. No.: 6,664,461, issued Dec. 16, 2003.

FIELD OF THE INVENTION

This invention relates to a stringed musical instrument and, snore particularly, to an electric stringed musical instrument with a frame.

DESCRIPTION OF THE RELATED ART

A violin, viola cello and double-bass are members of the violin family, and the violin family is essential musical instruments of an orchestra. A standard cello is of the order of 120 centimeters, and is twice longer than a standard violin. The standard cello is four times wider than the standard violin. The double-bass is of the order of 2 meters long, and is almost twice as long as the cello. The compass of a stringed musical instrument is dependent on the length of the string, the specific gravity of the string and the tension exerted on the string. The longer the string is, the lower the pitched part is. For this reason, the compass of the cello is lower than that of the violin, and is higher than that of the double-bass.

The string player puts the body of the violin between the chin and the shoulder, and holds the neck with the left hand. The string player takes the how with the right hand, and plays the violin. The string player plays the viola in a similar manner, However, the string players stand the cello and the double-bass on a floor. The strings player sits on a chair, and puts the cello between the knees. The cello inclines toward the string player, and the body and/or the neck are put on the chest and/or shoulder, and bows the strings. The double-bass is usually played by a string player standing on a floor.

The body is an essential component part of the bowed stringed musical instrument of the violin family, and a resonator is formed in the body. A neck projects from the body, and strings are stretched over the neck and the body. When a player bows the strings, the strings vibrate, and the vibrations are propagated to the body. The body also vibrates for generating tones, and the resonator makes the tones loud. Thus, the bowed stringed musical instrument generates the loud tones through the resonator. Lower pitched tones require a large resonator. For this reason, the double-bass has the largest body in the violin family. A stringed musical instrument with a resonator is hereinbelow referred to as "acoustic stringed musical instrument." The violin, the viola, the cello and the double-bass described hereinbefore are categorized in the acoustic stringed musical instrument.

The acoustic bowed stringed musical instruments are prominently used in an orchestra. Although other orchestra members generate tones through other musical instruments in a symphony, the other tones do not drown the tones from the acoustic bowed stringed musical instruments, and the audience can discriminate the tones of the acoustic bowed stringed musical instruments from the other tones in a concert hall. Thus, the string player appreciates the resonator for the loudness. However, the loud tones are often a nuisance to the neighborhood. The string players feel it difficult to seek a practice room.

Although the loudness is reduced to some degree with muted strings, it is impossible to keep the acoustic stringed musical instruments silent during the practice. If the resonator were removed from the acoustic stringed musical instrument, the string player would practice the acoustic stringed musical instrument anytime anywhere. However, the resonator or the body is a delicate component part of the acoustic stringed musical instrument. For this reason, the acoustic stringed musical instrument is in decomposable.

In this situation, manufacturers for musical instruments offer electric stringed musical instruments such as an electric cello and an electric double-bass. Any acoustic resonator is not incorporated in the electric stringed musical instruments. While a string player is playing a tune on the electric stringed musical instrument, the vibrations of the strings are converted to an electric signal by means of a pick-up, and an electronic circuit imparts an appropriate envelope to the electric signal so as to give the tones the timbre close to that of the acoustic double-bass. The electric signal is supplied to a sound system, and the unique tones are produced in the sound system. The loudness is easily changeable. In fact, the loudness is drastically reduced to a tenth, and the acoustic energy is of the order of a hundredth. The four strings of a prior art electric stringed musical instrument are averaged at −20 dB. The drastically reduced loudness is as faint as whispers of human voice. Using the electric stringed musical instrument, the string player practices a tune at his or her home anytime.

FIGS. 1 and 2 show the prior art electric bowed stringed musical instrument. The prior art electric bowed stringed musical instrument is corresponding to the acoustic double-bass, and is hereinbelow referred to as "electric double-bass". The prior art electric double-bass is designated in its entirety by reference numeral 1.

The prior art electric double-bass 1 comprises a trunk 2, four strings 3 and a framework 4. The width of the trunk 2 is increased from the lower end to an intermediate portion, and is decreased from the intermediately portion toward the upper end. In other words, the trunk 2 slightly bulges. The trunk 2 is broken down into a relatively thick base, a relatively thin neck and a fingerboard 2*a*. The relatively thick base portion is integral with the neck. The fingerboard 2*a* is laminated on the relatively thin neck, and extends over the relatively thick base.

A peg box 4 is formed in the relatively thin neck of the trunk 2, and is provided with a scroll 5. Four pegs 7 are rotatably supported by the peg box 4. The four pegs 7 are associated with the four strings 3, respectively. The peg box 4, the scroll 5 and the pegs 7 are similar to those of the acoustic double-bass. A tail piece 8 is anchored to the lower end of the trunk 2, and is gradually spaced from the other end portion of the trunk 2 toward the fingerboard 2*a*. A nut 9*a* is embedded into the upper end of the fingerboard 2*a*, and another bridge 9*b* is upright to the trunk 2. The four strings 3 extend between the pegs 7 and the tail piece 8. The four strings 3 are anchored to the tail piece 8, and are wound on the associated pegs 7. The nut 9*a* and the bridge 9*b* rive tension to the strings 3. Thus, the four strings 3 are stretched over the fingerboard 2*a* and the trunk 2.

The framework 4 is broken down into a yoke 4*a* and a shaping board 4*b*. The yoke 4*a* is fixed to the trunk 2, and projects from a side surface of the trunk 2. The yoke 4*a* is shaped like a part of the side board of the acoustic double-bass defining the resonator together with the soundboard. The shaping board 4*b* is fixed to the other side surface of the trunk 2, and sideward projects from the trunk 2. The shaping board 4*b* is curved like the outline of a half of the body forming a part of the acoustic double-bass. The shaping board 4*b* is connected at both ends thereof to the side surface of the trunk 2, and is spaced from the trunk 2 between the connected portions. Any sound-board is not put over the space between the trunk 2 and the shaping board 4*b*. For this reason, any resonator is not formed in the prior art electric double-bass.

While a string player is bowing for playing the prior art electric double-bass, the shaping board 4*b* and the yoke 4*a* are held in contact with player's body for keeping the attitude of the prior art electric double-bass. For this reason, the shaping board 4*b* and the yoke 4*a* are shaped like the body of an acoustic double-bass.

An end-pin 10 projects from the lower end of the trunk 2. The end-pin 10 is retractable into the trunk 2. The end pin 10 is pressed a against a floor so that the prior art double-bass is maintained over the floor by the string player. Though not shown in the figures, a pick-up unit is provided on the trunk 2. and vibrations of the strings 3 are converted to an electric signal. The pick-up unit is connected to an electronic circuit (not shown), and the electric signal is supplied from the pick-up unit to the electronic circuit. The electronic circuit shapes the electric signal into an audio signal representative of the tones close to those of the acoustic double-bass. The audio signal is supplied to a sound system (not shown), and tones are produced from the audio signal through the sound system. The sound system includes a headphone, and the string player hears the tones through the headphone. Since the prior art electric double-bass does not have any resonator, the strings 3 merely generate faint tones, and the faint tones are not a nuisance to the neighborhood.

Although the prior art electric double-bass is narrower than the acoustic double-bass, the prior art electric double-bass is so large that the string player feels the prior art electric double-bass bulky. In other words, a problem is encountered in the prior art electric double-bass in the portability. The manufacturer makes an electric double-bass on an experimental basis. The manufacturer eliminates the shaping board 4*b* from the prior art electric double-bass. However, the electric double bass made on the experimental basis is unstable. While a string player is bowing, the trunk is liable to turn around the end pin. Thus, there is a trade-off between the prior art electric double-bass and the electric double-bass made on the experimental basis.

SUMMARY OF THE INVENTION

It is therefore an important object of the present invention to provide an electric stringed musical instrument, which is improved in portability without sacrifice of the stability.

To accomplish the object, the present invention proposes to make a framework detachable.

In accordance with one aspect of the present invention, there is provided a stringed musical instrument comprising a body without a resonator and separable into plural parts, a neck projecting from the body, strings stretched over the body and the neck and an electric sound generating system associated with the strings for generating electric tones on the basis of vibrations produced in the strings.

In accordance with another aspect of the present invention, there is provided a stringed musical instrument comprising a trunk, a detachable framework sideward projecting from the trunk, at least one coupling unit connecting the detachable framework to the trunk without forming, a resonator, strings stretched over the trunk and independently producing vibrations by a player and an electric sound generating system associated with the strings for producing electric tones on the basis of the vibrations.

In accordance with vet another aspect of the present invention, there is provided a stringed musical instrument comprising a trunk elongated in a first direction, a detachable framework projecting from the trunk in a second direction perpendicular to the first direction, coupling units for connecting the detachable framework to the trunk without forming resonator, a peg box formed in one end portion of the trunk, pegs supported by the peg box and independently rotatable with respect to the peg box, a fingerboard attached to one end portion of the trunk, a tail piece connected to the other end portion of the trunk, strings stretched over the fingerboard between the pegs and the tail piece and independently producing vibrations by a player, a nut and a bridge respectively attached to the fingerboard and the trunk so as to pass the strings thereover and an electric sound generating system having a pick-up unit supported by the trunk for converting the vibrations to electric detecting signals, an electric circuit connected to the pick-up unit for producing an audio signal through a signal processing and a sound system connected to the electric circuit for generating electric tones from the audio signal.

BRIEF DESCRIPTION OF THE DRAWINGS

The features and advantages of the electric stringed musical instrument will be more clearly understood from the following description taken in conjunction with the accompanying drawings in which.

DESCRIPTION OF THE PREFERRED EMBODIMENTS

First Embodiment

Figure 1:
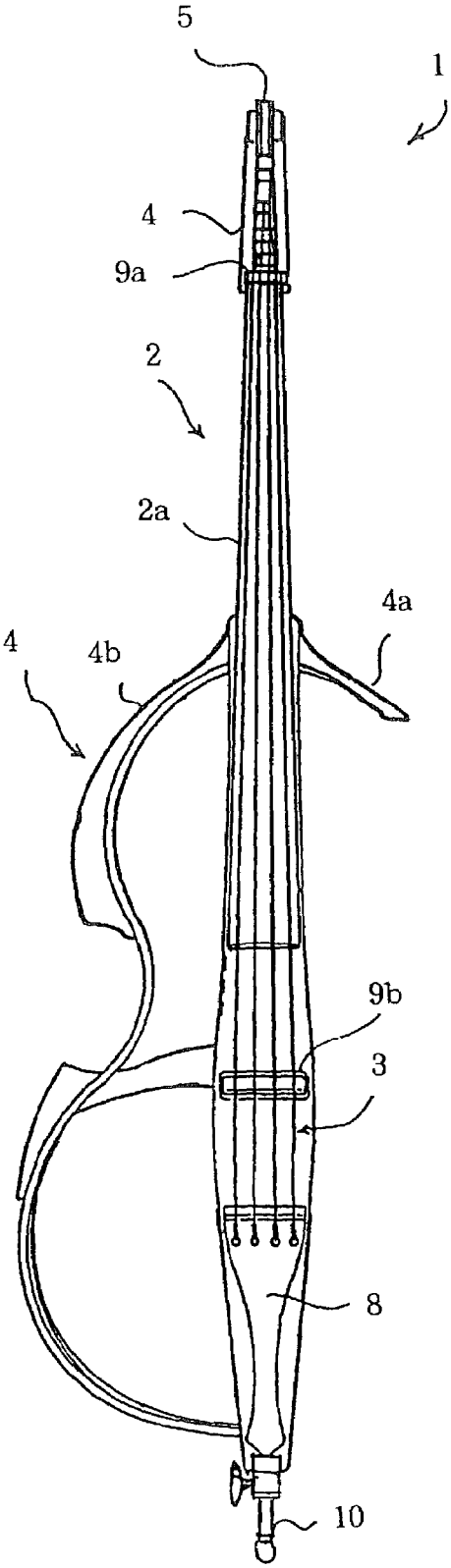
Fig. 1 PRIOR ART
FIG. 1 is a front view showing the structure of the prior art electric bowed stringed musical instrument.
Figure 2:
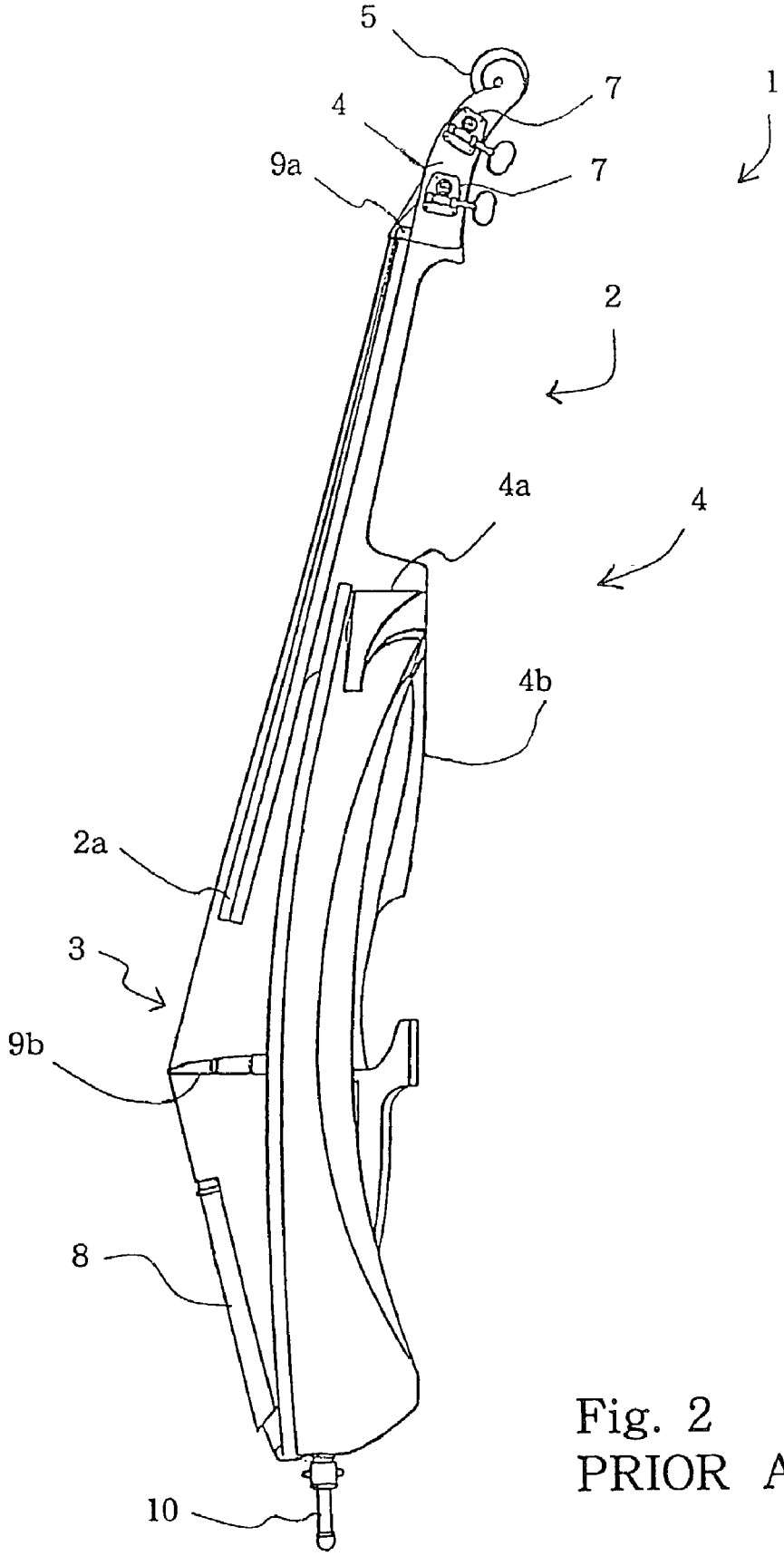
Fig. 2 PRIOR ART
FIG. 2 is a side view showing the structure of the prior art electric bowed stringed musical instrument viewed from the different angle.
Figure 3:
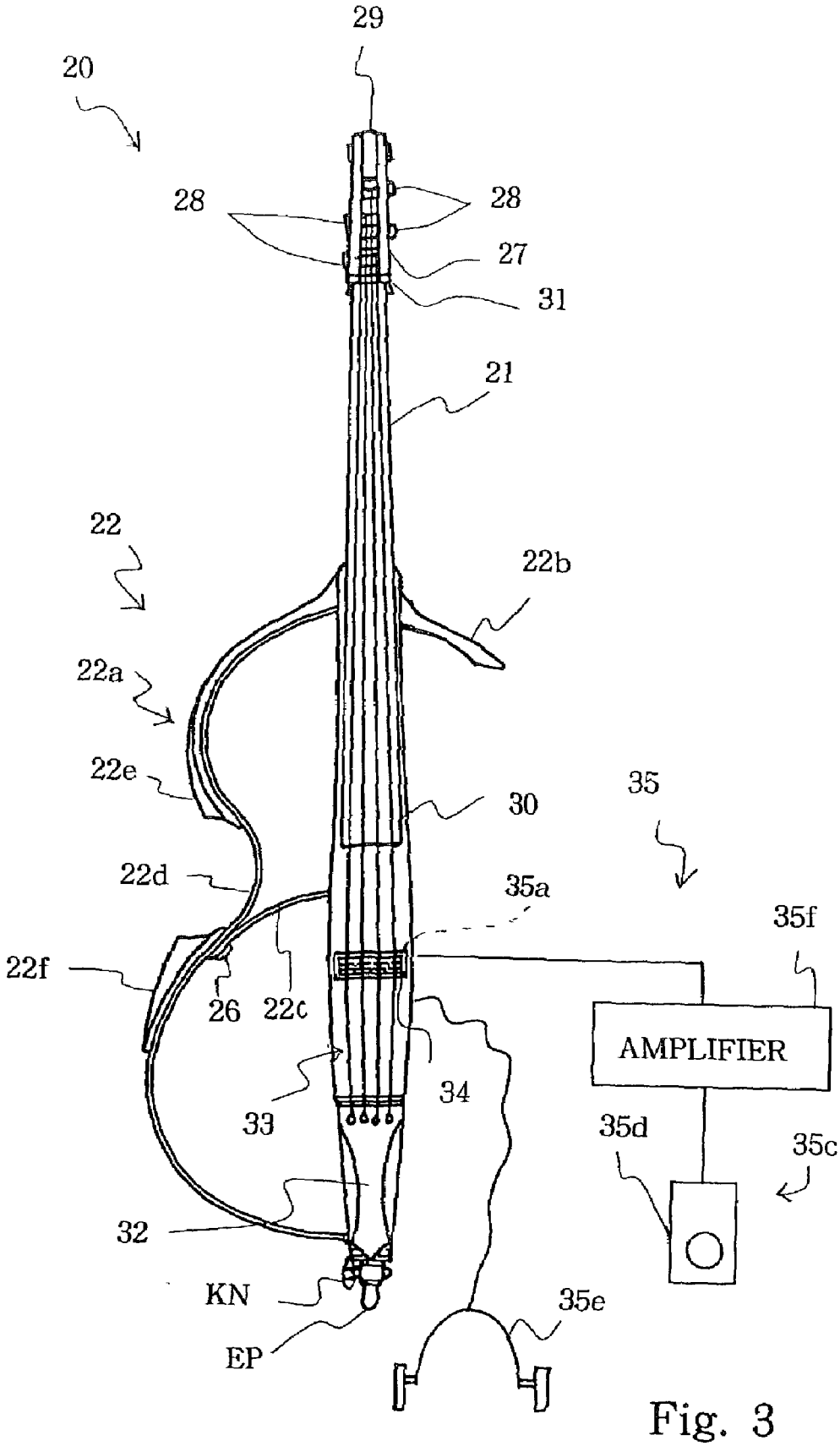
FIG. 3 is a front view showing the structure of an electric bowed stringed musical instrument according to the present invention.
Figure 4:
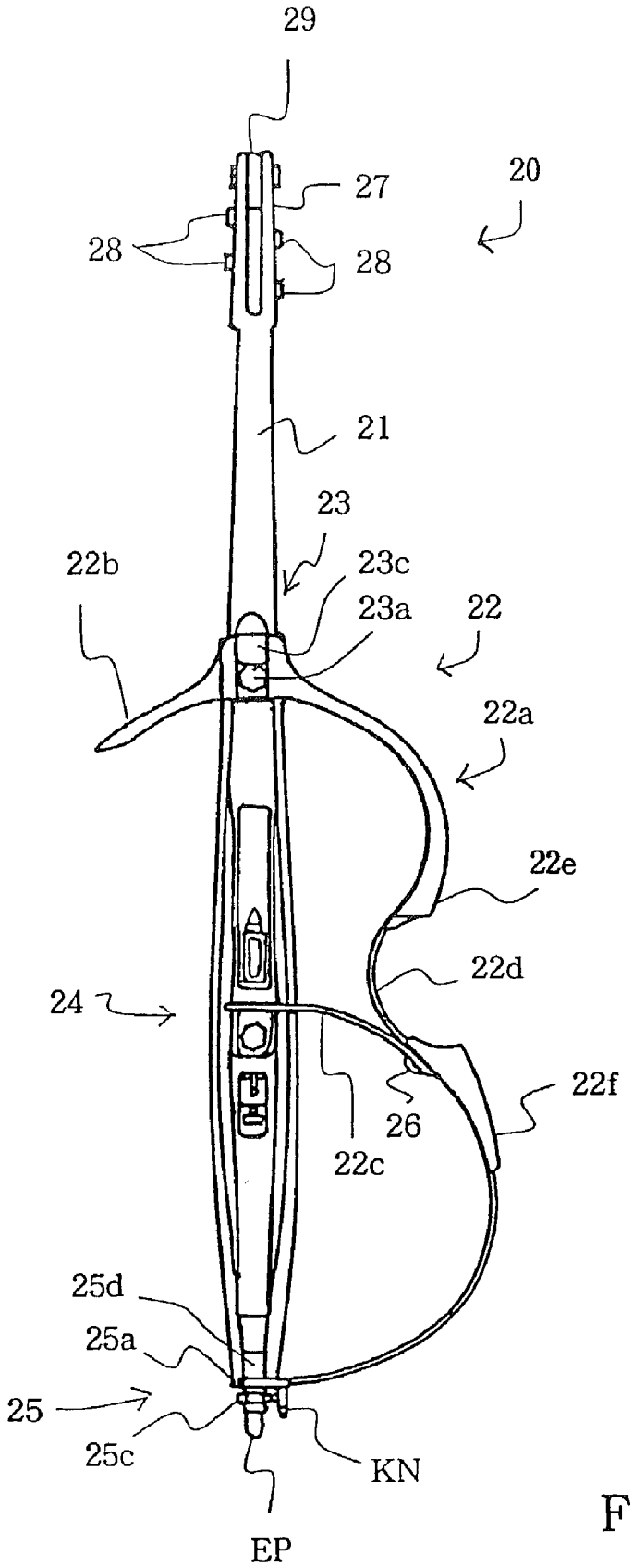
FIG. 4 is a rear view showing the structure of the electric bowed stringed musical instrument.

Referring to FIGS. 3 and 4 of the drawings, an electric bowed stringed musical instrument embodying the present invention is designated in its entirety by reference numeral 20. The electric bowed stringed musical instrument 20 is designed to be bowed in the similar manner to a standard acoustic double-bass. For this reason, the electric double-bass 20 is as long as the standard acoustic double-bass, and is hereinbelow referred to as "electric double-bass".

The electric double-bass 20 according to the present invention comprises a trunk 21, a detachable framework 22 and coupling units 23, 24 and 25 for connecting the detachable framework 22 to the trunk 21. The trunk 21 is similar to the trunk 2 of the prior art electric double-bass 1, and no further description is hereinbelow incorporated for the sake of simplicity. The framework 22 is detachably connected to the thick portion of the trunk 21

The framework 22 includes a shaping frame 22*a*, a yoke 22*b* and a connecting plate 22*c*. However, any resonator is formed in the framework 22. The shaping frame 22*a* is connected at both ends thereof to the rear surface of the trunk 21 by means of the coupling units 23 and 25. The shaping frame 22*a* sideward project from the trunk 21, and the yoke 22*b* projects from the other side surface of the trunk 21 in the opposite direction. The connecting plate 22*c* is curved, and is connected at one end thereof to the shaping frame 22*a* by means of a pin 26 and at the other end thereof to the rear surface of the trunk 21 by means of the coupling unit 24. The connecting plate 22*c* prevents the shaping frame 22*a* from undesirable deformation. The pin 26 permits the connecting plate 22*c* to rotate therearound.

The shaping frame 22*a* has a contour similar to the outline of a half of the body of an acoustic double-bass, and recalls the acoustic double-bass to player's mind. The shaping frame 22*a* is broken down into a plate 22*d* and pads 22*e* and 22*f*. The shaping frame 22*a* is shaped like the Arabic numeral "3", and the pads 22*e* and 22*f* are attached to the plate 22*d*. The pads 22*e* and 22*f* are located at the position where strings players are held in contact. In this instance, the plate 22*d* is formed of metal or alloy, and the pads 22*e* and 22*f* are formed of wood or synthetic resin.

The yoke 22*b* is a short bar, and is symmetry with a corresponding portion of the shaping frame 22*a*. The yoke 22*b* is gently curved and has the contour similar to a shoulder portion of the body of the acoustic double-bass. As will be described hereinbelow, the yoke 22*b* is turnably connected to the shaping frame 4*b*, and, accordingly is foldable toward the shaping frame 4*b*. In this instance, the yoke 22*b* is formed of wood or synthetic resin.

The connecting plate 22*c* is gently curved, and is connected at one end thereof to an intermediate portion of the plate 22*d* by means of the pin 26. The other end of the connecting plate 22*c* is connected to the trunk 21 by means of the coupling unit 24. The connecting plate 22*c* makes the span between the connecting portions between the trunk 21 and the shaping frame 22*a*. For this reason, even if external force is exerted to the shaping frame 22*a* toward the trunk 21, the connecting plate 22*c* keeps the contour of the shaping frame 22*a* unchanged. When the coupling unit 24 releases the connecting plate 22*c* from the trunk 21, the connecting plate 22*c* turns around the pin 26, and changes the position in such a manner as to be close to the lower portion of the shaping, frame 22*a*.

A rigid plate 23*b* (see FIG. 7), a bolt, a knob 23*a* and a cover plate 23*c* form in combination the coupling unit 23. The rigid plate 23*b* is fixed to the trunk 21, and a threaded hole 23*d* is formed in a central portion of the rigid plate 23*b*. The bolt projects from the knob 23*a*. The bolt passes through a hole formed in the cover plate 23*c*, and is rotatably supported by the cover plate 23*c*. The cover plate 23*c* is fixed to the shaping frame 22*a*. A string player aligns the bolt with the threaded hole 23*d*, and rotates the knob 23*a* in a certain direction. The bolt is screwed into the threaded hole 23*d*, and the cover plate 23*c* is pressed against the rigid plate 23*b*. As a result, the shaping frame 22*a* and the yoke 22*b* are connected to the trunk 21. If the knob 23*a* is rotated in the opposite direction, the bolt is taken off, and the cover plate 23*c* is unfastened from the rigid plate 23*b*. Accordingly, the shaping frame 22*a* and the yoke 22*b* are separated from the trunk 21.

The coupling unit 24 is similar to the coupling unit 23, and includes a rigid plate 24*a* fixed to the trunk 21, a bolt 24*b* projecting from a knob and a cover plate rotatably supporting the bolt 24*b*. The cover plate 24*c* is fixed to the connecting plate 22*c*. A threaded hole 24*d* is also formed in the rigid plate 24*a*, and the bolt 24*b* is screwed into and out of the threaded hole 24*d*. Thus, the connecting plate 22*c* is fastened to and unfastened from the trunk 21 by means of the coupling unit 24.

Figure 5A:
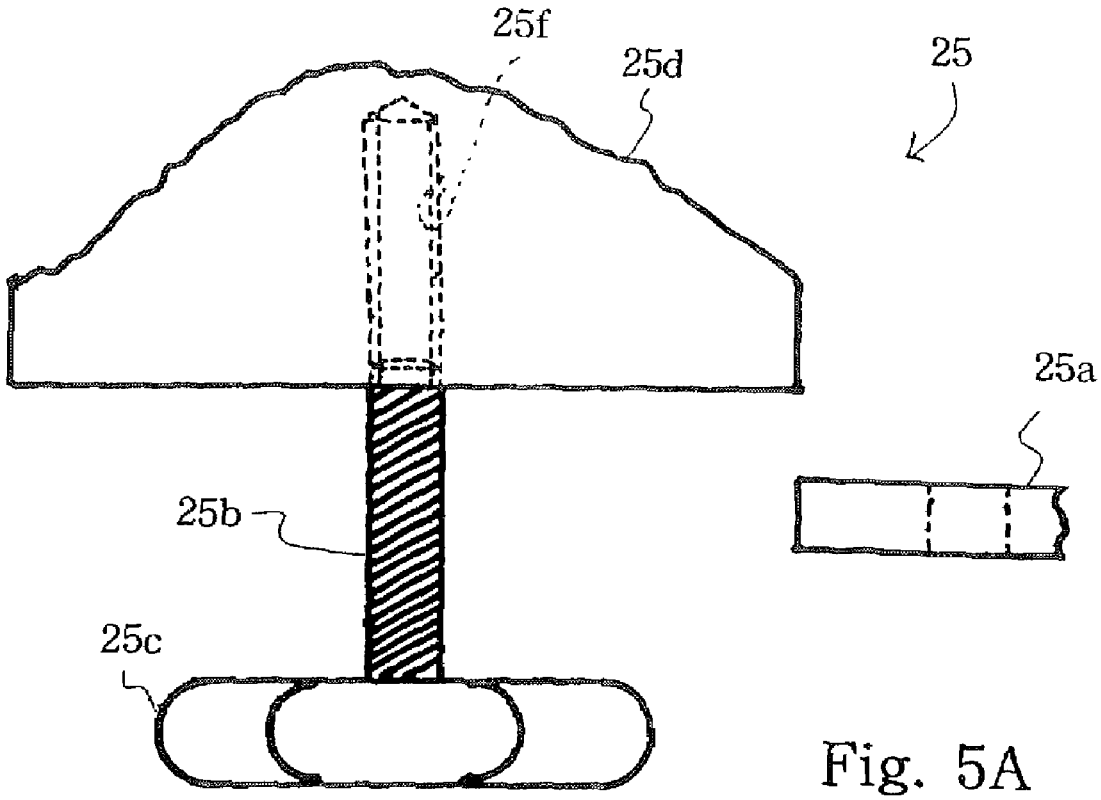
FIG. 5A is a front view showing a coupling incorporated in the electric bowed stringed musical instrument.
Figure 5B:
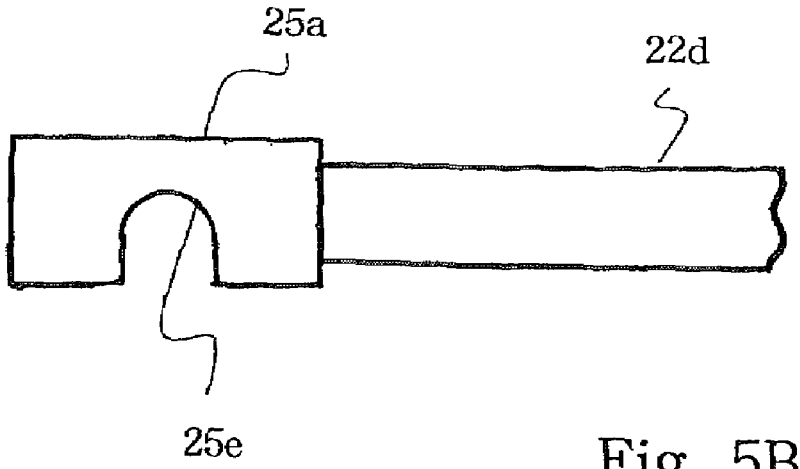
FIG. 5B is a bottom view showing a part of the coupling unit.

Turning to FIGS. 5A and 5B, the coupling unit 25 includes a plate 25*a*, a bolt 25*b*, a knob 25*c* and a bottom portion 25*d*. The plate 25*a* is connected to the frame 22*d*, and a hole 25*e* is formed in the plate 25*a*. The hole 25*e* is slightly wider than the bolt 25*b*. The bolt 25*b* projects from the knob 25*c*. The trunk 21 has the bottom portion 25*d*, and a threaded hole 25*f* is formed in the bottom portion 25*d*. Alternatively, the threaded hole 25*f* may be formed in a plate, which is attached to the bottom portion 25*d*. The bolt 25*b* is screwed into and out of the threaded hole 25*f*. When the string player assembles the shaping frame 22*a* with the trunk 21, the string player pushes the plate 25*a* toward the bolt 25*b* so as to place the bolt 25*b* into the hole 25*e*. Then, the plate 25*a* is laminated on the bottom portion 25*d*. The string player turns the knob 25*c*, and fastens the plate 25*a* to the bottom portion 25*d*. When the string player separates the shaping frame 22*a* from the trunk 21, the string player loosens the bolt 25*b* with the knob 25*c*, and removes the plate 25*a* from the bottom portion 25*d*. The bolts 25*b* remains partially screwed into the bottom portion 25*d*. Thus, the shaping frame 22*a* is connected to and separated from the trunk 21 by means of the coupling unit 25.

Turning back to FIGS. 3 and 4, the electric double-bass 20 further comprises a peg box 27, four pegs 28, a scroll 29, a fingerboard 30 and a nut 31. In this instance, the peg box 27 is integral with the trunk 21, and the scroll 29 is inserted into the peg box 27. The pegs 28 are rotatably supported by the peg box 27, and each of the pegs 28 has a shaft, a worm Tear, a knob and a worm wheel. The shaft laterally extends over the gap formed in the peg box 27, and the worm wheel is attached to the shaft. The knob is rotatably supported on the side surface of the peg box 27, and the worm gear is connected to the knob. The worm gear is meshed with the worm wheel. The knob is driven for rotation by a string player so as to rotate the shaft. Thus, the pegs 28 are identical in function with those of the acoustic double-bass. The fingerboard 30 is attached to the front surface of the trunk 21, and the nut 31 is embedded into the fingerboard in the proximity with the peg box 27. Thus, the peg box 27, the pegs 28 the scroll 29, the fingerboard 30 and the nut 31 imitate the appearance of the acoustic double-bass.

The electric double-bass 20 further comprises a tail piece 32, four strings 33, a bridge 34, an end pin EP and a knob KN. The tail piece 32 is attached to the trunk 21, and is spaced from the fingerboard 30. The bride 34 is provided on the front surface the trunk 21, and is upright to the front surface of the trunk 21 between the fingerboard 30 and the tail piece 32. The four strings 33 are anchored to the tail piece 32, and are wound on the pegs 28. Thus, the four strings 33 are stretched substantially in parallel to one another over the fingerboard 30 and the exposed front surface of the trunk 21 between the associated pegs 28 and the tail piece 32. The nut 31 and bridge 34 give tension to the four strings 33. The strings for the acoustic double-bass are available for the electric double-bass 20. The strings 33 are less expandable. For this reason the pegs 28 are driven for rotation by means of the worm ear and the worm wheel. The end pin EP downwardly projects from the trunk 21. The end pin EP is retractable into the trunk 21, and is positioned at an arbitrary position by means of the knob KN. The end pin EP keeps the trunk 21 over a floor.

The electric double-bass 20 further comprises an electric sound generating system 35. The electric sound generating system 35 converts the vibrations of the strings 33 to an analog audio signal and, thereafter, generates electric tones on the basis of the analog audio signal. In this instance, the electric sound generating system 35 includes a pick-up unit 35*a* and an electric circuit (not shown). The electric circuit is built in the trunk 21, and is connected to a sound system 35*c*. The pick-up unit 35*a* is provided under the bridge 34, and is sandwiched between the bridge 34 and the trunk 21. The pick-up unit 35*a* has two piezoelectric elements. Only one or more than two piezoelectric elements may be incorporated in the pick-up unit 35*a*. The piezoelectric elements convert the vibrations of the strings 33 to analog detecting, signals. The pick-up unit 35*a* is connected to the electric circuit, and the analog detecting signals are supplied from the pick-up unit 35*a* to the electric circuit. The electric circuit carries out an equalization in the analog detecting signals so as to produce an audio signal. The audio signal represents a timbre close to that of the acoustic double-bass. The electric circuit is connected to the sound system 35*c*. A speaker unit 35*d* and a headphone 35*e* are incorporated in the sound system 35*c*. Although the electric circuit directly supplies the analog audio signal to the headphone 35*e*, the analog audio signal is firstly supplied to an appropriate amplifier 35*f*, and, thereafter, is supplied from the amplifier 35*f* to the speaker unit 35*d*. The electric tones are radiated from the speaker unit 35*d* and/or the headphone 35*e*. Thus, the electric sound generating system 35 generates the audio signal from the vibrations of the strings 33, and the sound system 35*c* generates the electric tones like those of the acoustic double-bass.

Figure 6:
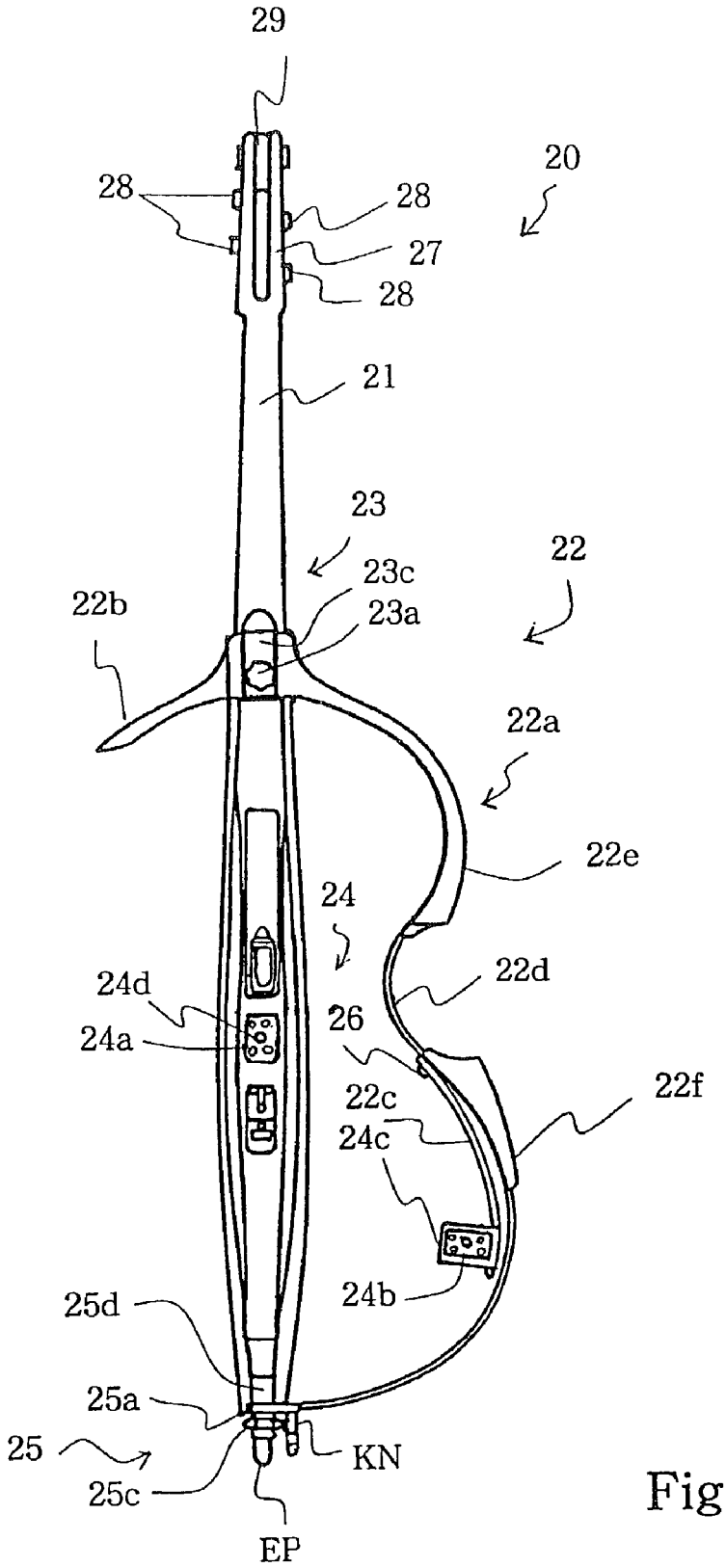
FIG. 6 is a rear view showing a framework partially disconnected from a trunk.

The electric double-bass 20 is disassembled as follows. First, the string player rotates the knob and, accordingly, the bolt 24*b*, and takes off. Then, the cover plate 24*c* is unfastened from the rigid plate 24*a*. The string player turns the connecting plate 22*c* around the pin 26, and folds the connecting plate 22*c* on the inner surface of the shaping frame 22*a* as shown in FIG. 6.

Figure 7:
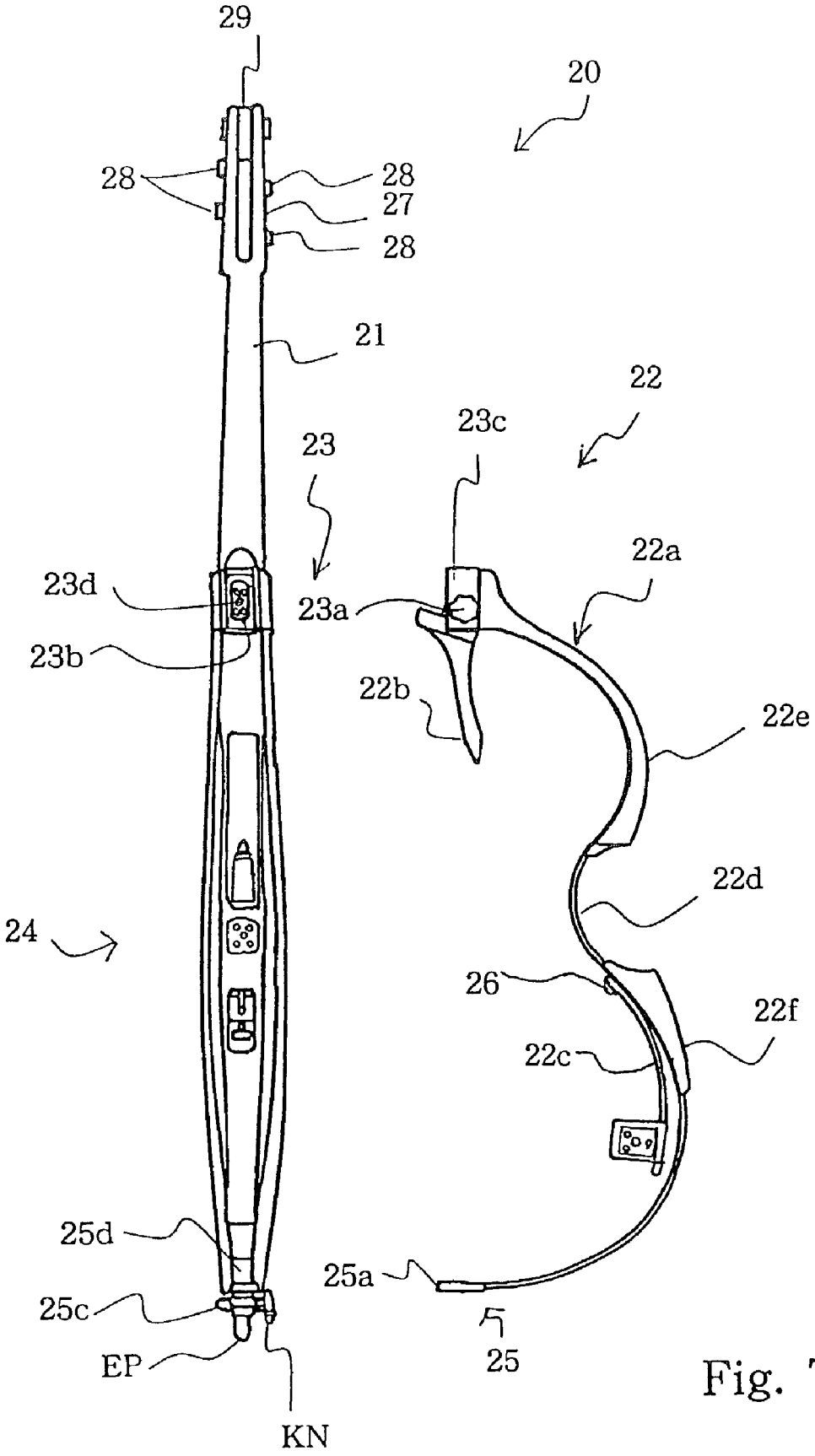
FIG. 7 is a rear view showing the frame work perfectly disconnected from the trunk.

Subsequently, the string player turns the knobs 23*a* and 25*c*, and loosens the bolts. The cover plates 23*c* are unfastened from the associated rigid plate 23*b*, and the plate 25*a* is separated from the bottom portion 25*d*. Thus, the framework 22 is released from the trunk 21. Finally, the yoke 22*b* is folded as shown in FIG. 7. The folded yoke 22*b* is desirable, because the string player accommodates the trunk 21 and the framework 22 in a narrow case. As will be understood, the framework 22 is detachable from the trunk 21, and the electric double-bass 20 is improved in the portability by virtue of the detachable framework 22.

When the string player assembles the framework 22 and the trunk 21 together, the string player takes the above-described order backward, and connects the electric circuit to the sound system 35*c*. Then, the string player gets ready for playing the electric double-bass 20. While the string player is bowing, the strings 33 selectively vibrate, and the vibrations are converted to the analog detecting signals by means of the pick-up unit 35*a*. The electric circuit regulates the volume balance, and makes the timbre like that of the acoustic tones. The electric circuit supplies the analog audio signal to the sound system 35*c*, and the sound system 35*c* generates the electric tones from the analog audio signal.

If the string player wants to practice the electric double-bass 20 silently, the string player instructs the electric circuit to supply the analog audio signal only to the headphone 35*e*, and starts the bowing. Although the strings 33 are vibrating, the strings 33 faintly generate the acoustic tones. The string player can hear the electric tones through the headphone 35*e* without any disturbance to the neighborhood. When another analog audio signal is supplied to the electric circuit from the outside, the string player can practice ensemble together with another silent musical instrument and/or a CD (Compact Disk) player.

As will be appreciated from the foregoing description, the framework 22 is detachable from the trunk 21, and enhances the portability of the electric double-bass 20 according to the present invention.

Second Embodiment

An electric cello embodying the present invention largely comprises a trunk, a detachable framework, coupling units, strings, accessory parts and a sound generating system. A standard acoustic cello is smaller in size than the standard acoustic double-bass. Although the electric cello is different in dimensions from the electric double-bass, the electric cello is similar in structure to the electric double-bass. In this instance, the electric cello is as long as the acoustic cello, and the strings are shared between the electric cello and the acoustic cello. For this reason, the electric cello is not shown in the drawings. However, there are several differences between the electric cello and the electric double-bass 20.

The standard acoustic cello is usually bowed by a string player who sits on a chair. This means that the electric cello is held in contact with the string player at different positions from those of the electric double-bass during the performance. For this reason, the framework of the electric cello has pads differently attached to a plate.

The detachable frameworks according to the present invention are appreciated for the large-sized bowed stringed musical instruments of the violin family. However, the detachable framework is available for other members of the electric violin family such as an electric violin and an electric viola. The detachable framework permits a string player to carry the electric violin or the electric viola in a small case. Thus, the detachable framework is desirable for the other members of the electric violin family.

In the above-described embodiments, the relatively thick base of the trunk 21, the framework 22 and the coupling units 23, 24 and 25 as a whole constitute a body without any resonator, and the relatively thin neck of the trunk 21 serves as a neck. The thick portion is corresponding to a stem.

Although particular embodiments of the present invention have been shown and described, it will be apparent to those skilled in the art that various changes and modifications may be made without departing from the spirit and scope of the present invention.

For example, the pick-up unit 35*a* may be directly provided on or in the trunk 21, the bridge 34 or the fingerboard 30. The trunk 21 may be separable into more than one piece. The electric circuit may have an equalizer for producing the analog audio signal. The harmonics may be controlled for producing the analog audio signal.

The coupling units 23, 24 and 25 are used for assembling the trunk and the framework together. In the above-described embodiments, the framework is connected to the trunk through the threaded engagement between the male screws and the female screws. The male screws and the female screws never set any limit on the present invention. A nipple and a socket may be used as another example of the coupling.

Another example of the coupling is a wedge and a stopper. Wedges are formed at both end portions of the shaping frame 22*a* and at one end portion of the connecting plate 22*c*, and holes are formed in the trunk 21. Stoppers are provided in the holes, and are linked with appropriate buttons. Springs urge the wedges at all times. When the wedge is inserted into the hole, the wedge pushes the stopper along the oblique surface thereof against the spring, and the stopper is engaged with the back surface of the wedge. The stopper does not allow the wedge to move backward. When the string player pushes the button, the button evacuates the stopper from the back surface of the wedge, and the string player moves the wedge out of the hole.

Another example of the coupling unit is a toggle joint. An electromagnetic clutch may be used as yet another example of the coupling unit.

The pick-up unit 35*a* electromagnetically produces the analog detecting signal from the vibrations of the strings 23. Another pick-up unit may be implemented by a photo-couplers for producing the analog detecting signals representative of the vibrations of the strings 23. Yet another pick-up unit may include coils so as to produce the analog detecting signals through the electromagnetic induction.

The present invention may appertain to another kind of stringed musical instrument performed by a player through plucking.

The sound system may be built in the trunk 21.

The invention claimed is:

1. A stringed instrument comprising:

a trunk having one end portion and an other end portion, and elongated in a longitudinal direction thereof;

a frame body sidewardly projecting from said trunk, and having relatively thick portions where a human player is held in contact during a performance and relatively thin portions connected between said relatively thick portions and between said trunk and said relatively thick portions, said relatively thin portions having a stiffness greater than the stiffness of said relatively thick portions;

at least two coupling units provided between said one end portion of said trunk and a portion of said frame body and between said other end portion of said trunk and another portion of said frame body so as to make said frame body detachable from said trunk;

at least one string stretched over said trunk in a direction parallel to said longitudinal direction, said human player giving rise to vibrations during said performance; and an electric sound generating system detecting said vibrations of said at least one string for generating electric tones.

2. The stringed instrument as set forth in claim 1, in which the detachable frame body has a contour similar to a part of a body incorporated in an acoustic stringed instrument.

3. The stringed instrument as set forth in claim 2, in which said part of said body is more than a half of the outline of said body.

4. The stringed instrument as set forth in claim 1, in which said frame body has a contour similar to a part of a body incorporated in an acoustic stringed instrument, and said relatively thick portions are corresponding to portions of said body where a human player is held in contact during a performance on said acoustic stringed instrument.

5. The stringed instrument as set forth in claim 1, in which said relatively thin portions are formed of material selected from the group consisting of metal and alloy, and said relatively thick portions are formed of material selected from the group consisting of wood and synthetic resin.

* * * * *